United States Patent [19]

Davidson et al.

[11] 4,282,838

[45] Aug. 11, 1981

[54] ENGINE OVERSPEED SHUT-DOWN SYSTEM

[75] Inventors: Harold C. Davidson, Chillicothe; John H. Parks, Peoria, both of Ill.

[73] Assignee: Caterpillar Tractor Co., Peoria, Ill.

[21] Appl. No.: 81,218

[22] PCT Filed: Mar. 2, 1979

[86] PCT No.: PCT/US79/00128

§ 371 Date: Mar. 2, 1979

§ 102(e) Date: Mar. 2, 1979

[87] PCT Pub. No.: WO80/01821
PCT Pub. Date: Sept. 4, 1980

[51] Int. Cl.[3] ..... F02B 77/08

[52] U.S. Cl. ..... 123/198 DB; 123/365; 123/196 S

[58] Field of Search ..... 123/351, 364, 365, 372, 123/374, 196 S, 198 D, 198 DB

[56] References Cited

U.S. PATENT DOCUMENTS

| | | | |
|---|---|---|---|
| 2,340,270 | 1/1944 | Leliter | 123/374 |
| 2,758,584 | 8/1956 | Hogeman et al. | 123/372 |
| 2,803,235 | 8/1957 | Goschel et al. | 123/365 |
| 2,831,474 | 4/1958 | King et al. | 123/198 DB |
| 2,841,130 | 7/1958 | Reggio | 123/365 |
| 3,814,072 | 6/1974 | Gillespie | 123/351 |

*Primary Examiner*—P. S. Lall
*Attorney, Agent, or Firm*—Phillips, Moore, Weissenberger, Lempio & Majestic

[57] ABSTRACT

A system for shutting-down an engine upon overspeeding thereof comprises an engine-driven shaft (19) having a flyweight mechanism (27) connected thereto and engageable with a reciprocally mounted trip shaft (32). The trip shaft (32) is, in turn, engageable with a pivotal latch (33) which is adapted to normally hold a spring-loaded control piston (44) in an inactive first position for permitting normal engine operation. A cable (12) connects the control piston (44) to a flapper valve (11), pivotally mounted in the intake manifold (13) of an engine. The manifold (13) is adapted to be closed upon tripping of the latch (33) to disengage the control piston (44) to permit its movement to an activated second position when the engine speed exceeds a predetermined maximum speed. Closing of the flapper valve (11) will create a vacuum in the intake manifold (13) which, in turn, opens a vacuum valve (14) mounted thereon to responsively move a rack (16) of a fuel control system (17) to a closed position to prevent communication of fuel to the engine.

28 Claims, 5 Drawing Figures

ENGINE OVERSPEED SHUT-DOWN SYSTEM

DESCRIPTION

1. Technical Field

This invention relates to a system for shutting-down an engine upon overspeeding thereof.

2. Background Art

Various systems have been proposed for shutting-down an engine when the speed thereof exceeds a predetermined maximum. Such systems normally comprise a hand lever, mounted in the operator's cab of a vehicle, which is adapted to be actuated to close-off communication of ambient air and/or fuel to the engine. Such a manual system is thus solely dependent on the operator for the engine shut-down operation which may not solve the overspeeding problem should the system become unattended, for example.

In addition, such conventional systems are somewhat complex and give rise to serviceability and reliability problems. The overspeed trip points of these systems normally cannot be adjusted to the proper setting with the engine running and, thus, require a trial and error procedure to effect such setting.

Also, in systems wherein the air and fuel are both shut-off, the air and fuel shut-off mechanisms employed in the system are normally mechanically dependent on each other and thus require a close calibration therebetween. This requirement gives rise to the possibility that the malfunction of a component of one of the mechanisms could adversely affect the operation of the other mechanism.

DISCLOSURE OF INVENTION

The present invention is directed to overcoming one or more of the problems as set forth above.

In one aspect of this invention, an overspeed shut-off system comprises first valve means movably mounted on an intake manifold of an engine for opening or closing the manifold to selectively communicate ambient air therethrough. A second valve means, also movably mounted on the intake manifold and disposed between the engine and the first valve means, is adapted for movement between open and closed positions for communication with a vacuum actuating means interconnected between a fuel control means of the engine and the second valve means. The vacuum actuating means functions to actuate the fuel control means to shut-off the supply of fuel from the fuel control means to the engine in response to the closing of the first valve means and the opening of the second valve means which communicates a vacuum from the intake manifold to the vacuum actuating means. An overspeed control means is connected to the first valve means and is responsive to the speed of the engine for automatically closing the first valve means when such speed exceeds a predetermined maximum.

This invention thus provides a highly efficient and reliable system for shutting-down an engine upon overspeeding thereof.

BRIEF DESCRIPTION OF DRAWINGS

Other objects of this invention will become apparent from the following description and accompanying drawings wherein.

BEST MODE OF CARRYING OUT THE INVENTION

Figure 1:
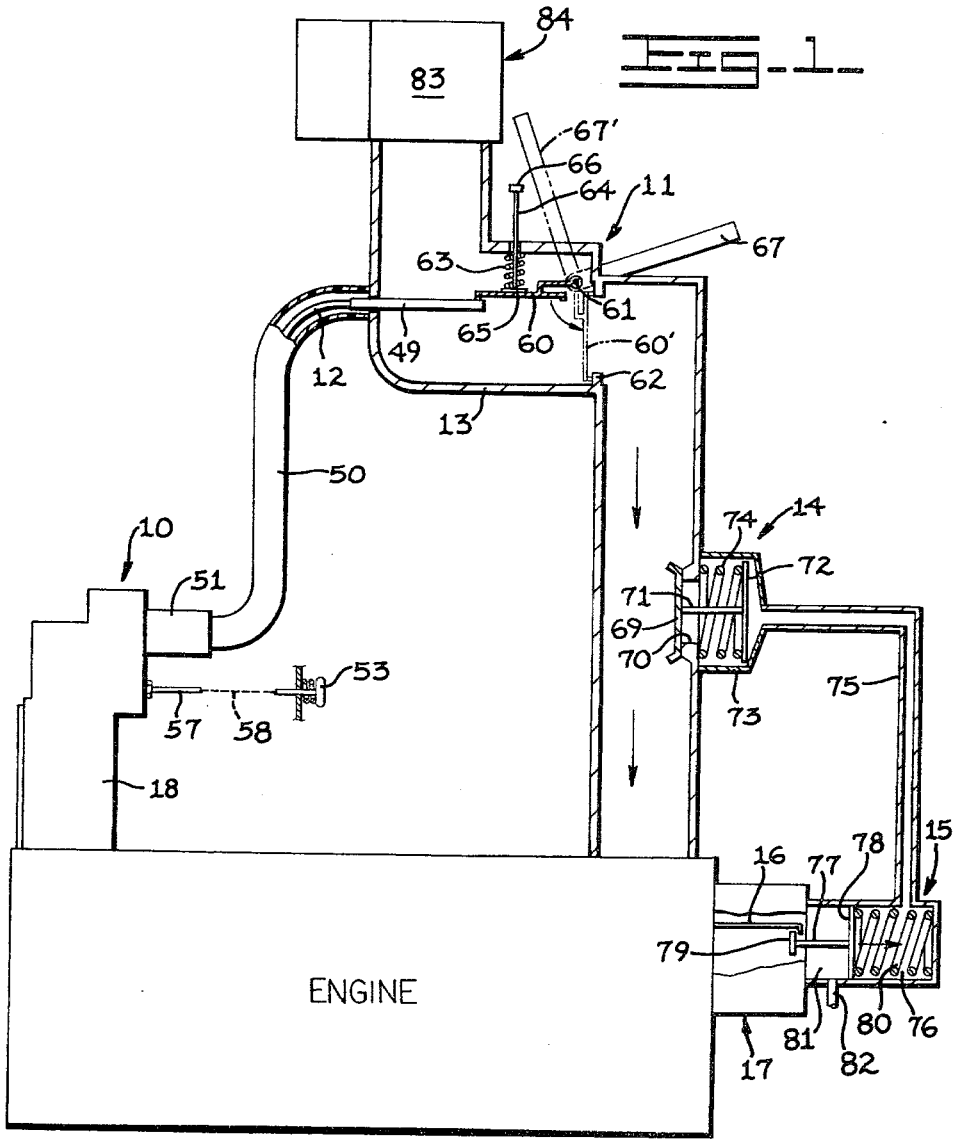
FIG. 1 illustrates the engine overspeed shut-down system of this invention in combination with an intake manifold and fuel control means of an internal combustion engine.

FIG. 1 illustrates a system for shutting-down an engine upon overspeeding thereof. The system comprises an overspeed control means 10 connected to a flapper valve or first valve means 11 by a push-pull cable 12. The flapper valve is movably mounted on an intake manifold 13 of the engine for opening or closing the manifold to selectively communicate ambient air therethrough, as will be hereinafter more fully described. Upon closing of the flapper valve in response to overspeeding of the engine, a vacuum valve or second valve means 14, also movably mounted on the intake manifold, will open due to the vacuum inherently created in the intake manifold upon continued running of the engine.

Opening of the vacuum valve will, in turn, communicate a vacuum to a vacuum actuating means 15, connected to a reciprocal rack 16 of a conventional fuel control means 17. Rightward movement of the rack will thus shut off the supply of fuel to the engine. The engine will thus stop, since neither ambient air nor fuel will be supplied thereto.

DETAILED DESCRIPTION

Figure 2:
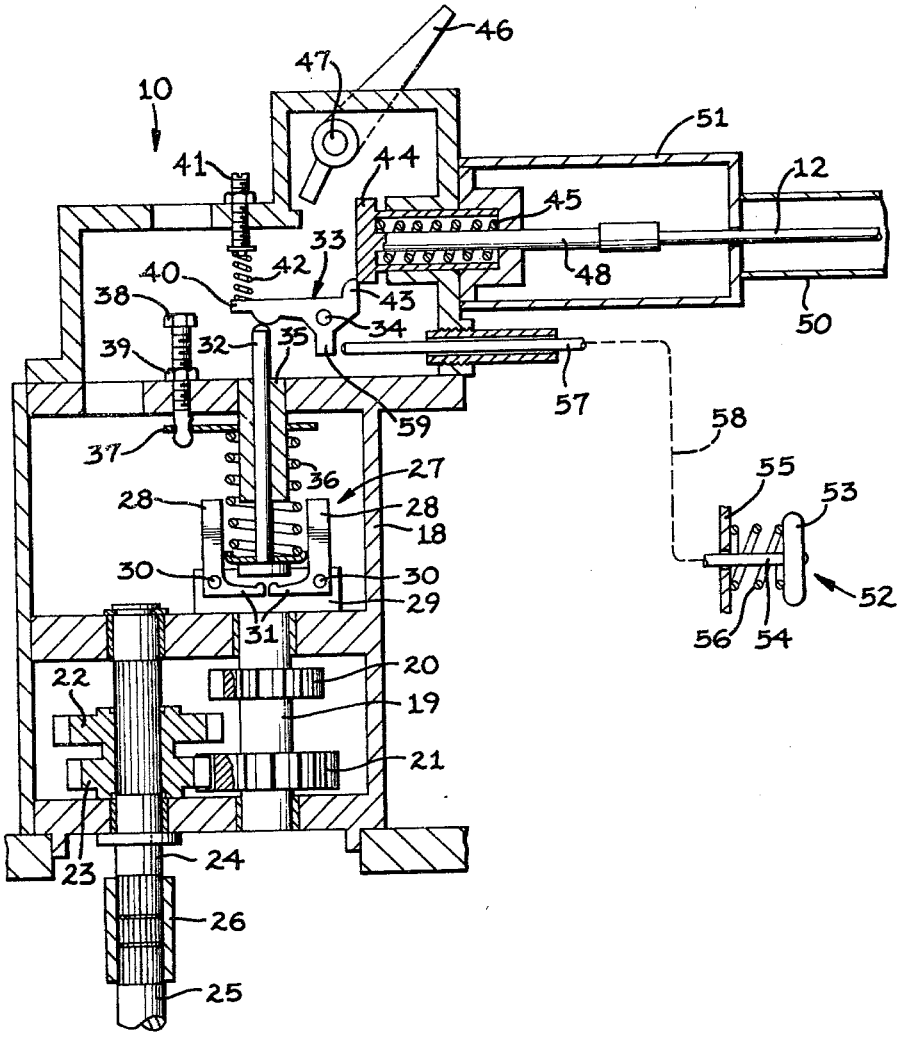
FIG. 2 is an enlarged sectional view of a control means employed in the overspeed shut-down system, shown in its inactivated condition of operation for permitting communication of ambient air and fuel to the engine during normal running thereof.

FIG. 2 illustrates overspeed control means 10 in its inactivated condition of operation whereby valves 11 and 14 are maintained in their opened and closed positions (FIG. 1), respectively. The control means comprises a housing 18 having a shaft 19 rotatively mounted therein. A pair of axially spaced gears 20 and 21 are secured on the shaft to comprise change speed gear means for selectively varying the rotary speed of the shaft.

The change speed gear means further comprises a pair of gears 22 and 23 slidably mounted on a second shaft 24, also rotatably mounted in housing 18. The latter gears are suitably attached to a standard yoke (not shown) which has a control lever disposed exteriorly of housing 18 whereby an operator may mesh gears 21 and 23 or mesh gears 20 and 22 for purposes hereinafter more fully explained. The drive input to shaft 24 is provided by a shaft 25 suitably connected thereto by a splined coupling 26 and further connected to a drive output of an engine (not shown) in a conventional manner.

Shaft 19 has a standard flyweight means or mechanism 27 suitably mounted thereon, including a pair of flyweights 28 pivotally mounted on a carrier 29, secured to the shaft, by pivot pins 30. The flyweights function in a conventional manner to pivot radially outwardly upon rotation of shaft 19. As will be described in detail hereinafter, a pair of arms 31 secured to flyweights 28 will engage a lower end of a trip means or shaft 32 to move it upwardly into engagement with a latch means or member 33 pivotally mounted on housing 18 by a pin 34. Trip shaft 32 is reciprocally mounted in a bushing 35, secured to the housing, and spring means 36, preferably comprising a compression coil spring, is disposed between arms 31 of the flyweights and an adjustable plate 37.

Spring 36 thus functions to counteract pivotal movement of the flyweights to control the force required to move trip shaft 32 upwardly. The counteracting force of the spring may be selectively adjusted by a set screw or adjusting means 38 which is threadably mounted on housing 18. A lower end of the set screw is rotatably mounted on plate 37 whereby release of a lock nut 39 will permit selective raising or lowering of plate 37 to thus impose a predetermined compressive force on spring 36 and arms 31 of flyweight means 27.

Adjustment means are also provided for applying a predetermined force to a first arm 40 of latch means 33. In particular, such adjustment means comprises a set screw 41 threadably mounted on the housing and spring means 42, preferably also comprising a compression coil spring, mounted between a lower end of the set screw and arm 40. The latter spring thus functions to urge arm 40 against the upper end of trip shaft 32 and a second arm or latch member 43 into engagement with the head of a piston or engine control means 44.

A spring means 45, preferably comprising a compression coil spring, is mounted between the head of the piston and housing 18 for normally urging the piston into engagement with latch member 43. A reset lever or means 46 is pivotally mounted on the housing by a pin 47 to recock the piston into its FIG. 2 position upon its release by latch means 33, as will hereinafter be more fully described. A push-pull cable 48 has one end thereof secured to piston 44 and the other end thereof secured to a trip pin 49, slidably mounted on intake manifold 13, as shown in FIG. 1. As further illustrated in FIGS. 1 and 2, a protective conduit 50 is secured between a tubular extension 51 of housing 18 and the intake manifold to provide full protection to cable 48.

Referring once again to FIG. 2, a manual shut-off means 52 comprises a knob or control member 53 secured to a rod 54, reciprocally mounted on a panel 55 which may be located in the operator's cab of a vehicle. The knob is biased rightwardly to an inoperative position by a compression coil spring 56, mounted between the knob and panel. Rod 54 is mechanically connected to a second rod 57, reciprocally mounted on housing 18, by a push-pull cable schematically illustrated at 58. The opposite end of rod 57 is disposed closely adjacent to a third arm 59 of latch means 33 whereby a pushing-in of knob 53 will, in turn, pivot the latch means counterclockwise to release piston 44 manually.

Figure 4:
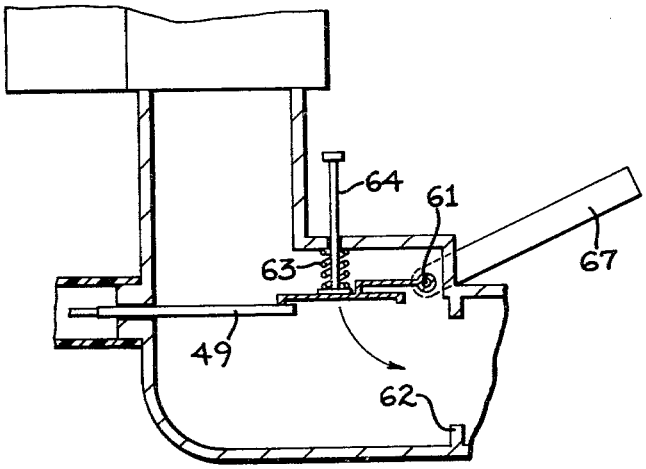
FIG. 4 is an enlarged detailed view of a flapper valve arrangement employed in the shut-down system.

Referring once again to FIG. 1, the release of the piston either upon overspeeding of the engine or upon depression of knob 53 will retract cable 12 and attached trip pin 49. An end of the trip pin is normally engaged beneath the end of a plate 60 of flapper valve 11 to hold it in its open position. Referring to FIGS. 1 and 4, plate 60 is pivotally mounted on manifold 13 by a pin 61 for pivotal movement to its closed position 60', against a stop 62 secured in the manifold.

Pivotal movement of the plate to its closed position is assisted by assist means comprising a compression coil spring 63. The spring is mounted on a rod 64 reciprocally mounted on a wall of the manifold and is confined between a washer 65, secured to the lower end of the rod, and the adjacent wall of the manifold. A stop member 66 is secured to an upper end of the rod to prevent the rod from falling within the manifold. Reset means for reopening the flapper valve upon restarting of the engine comprises a lever 67 pivotally mounted on the manifold by a pin 68; the lever being suitably secured to plate 60 for repositioning thereof to its FIG. 1 open position in the manifold.

Referring once again to FIG. 1, vacuum valve 14 comprises an annular member 69 normally covering an opening 70 formed through a sidewall of manifold 13. Member 69 is secured to a rod 71, having a plate 72 secured to an opposite end thereof and which has a diameter less than the inside diameter of a tubular housing 73 reciprocally mounting the rod and plate therein. The vacuum valve is biased to its illustrated normally closed position by a compression coil spring 74, mounted between the plate and manifold.

A conduit 75 communicates opening 70 with a chamber 76 defined in vacuum actuating means 15. The vacuum actuating means further comprises a piston having the first end of a rod 77 thereof secured to a reciprocal plate 78 which, alternatively, could constitute a flexible diaphragm having its periphery secured within the tubular housing confining the piston. The opposite end of the rod has a trip member 79 secured thereto, adapted to engage rack 16 to move it rightwardly when a vacuum is communicated to the vacuum actuating means via conduit 75. A compression coil spring 80 normally biases the piston leftwardly whereby rack 16 is positioned for normal engine operation. A suitable O-ring seal (not shown) is mounted above the periphery of annular plate 77 to isolate chamber 76 from a second chamber 81 which communicates with ambient air via an air vent 82.

INDUSTRIAL APPLICABILITY

FIGS. 1 and 2 illustrate the engine overspeed shut-off system of this invention conditioned for normal engine operation. During such operation, engine driven shaft 25 will rotate to, in turn, rotate shaft 19 via gears 21 and 23 and shaft 24. So long as the engine does not overspeed, flyweights 28 will pivot radially outwardly, but not to an extent to move trip shaft 32 upwardly to disengage latch means 33 from piston 44. Set screws 38 and 41 are suitably preadjusted to impose predetermined downward biasing forces on springs 36 and 42, respectively.

The maximum speed of shaft 19, whereby flyweights 28 will move trip pin 32 upwardly to disengage latch means 33 from piston 44, may be set by pre-testing without requiring overspeeding of the engine. In particular, the operator need only shift a yoke (not shown) to engage gears 20 and 22 and to disengage gears 21 and 23. Assuming that gears 20 and 22 have fifty teeth and fifty-nine teeth formed thereon, respectively, and that normal engine speed is 1,800 RPM, the trip speed of shaft 19 for disengaging latch means 33 from piston for testing purposes will be 2,125 RPM.

Further assuming that gears 21 and 23 have forty-eight and forty-eight teeth formed thereon, respectively, the trip speed of shaft 19 will be 2,125 RPM when the maximum engine speed for shut-off purposes is determined to be 18% times the normal engine speed of the engine (1,800 RPM). Thus, utlization of gears 20 and 22 for pretesting purposes will provide an artificial overspeed condition of engine operation for making certain that the overspeed shut-off system is operational when gears 21 and 23 are remeshed for normal engine operation.

Figure 3:
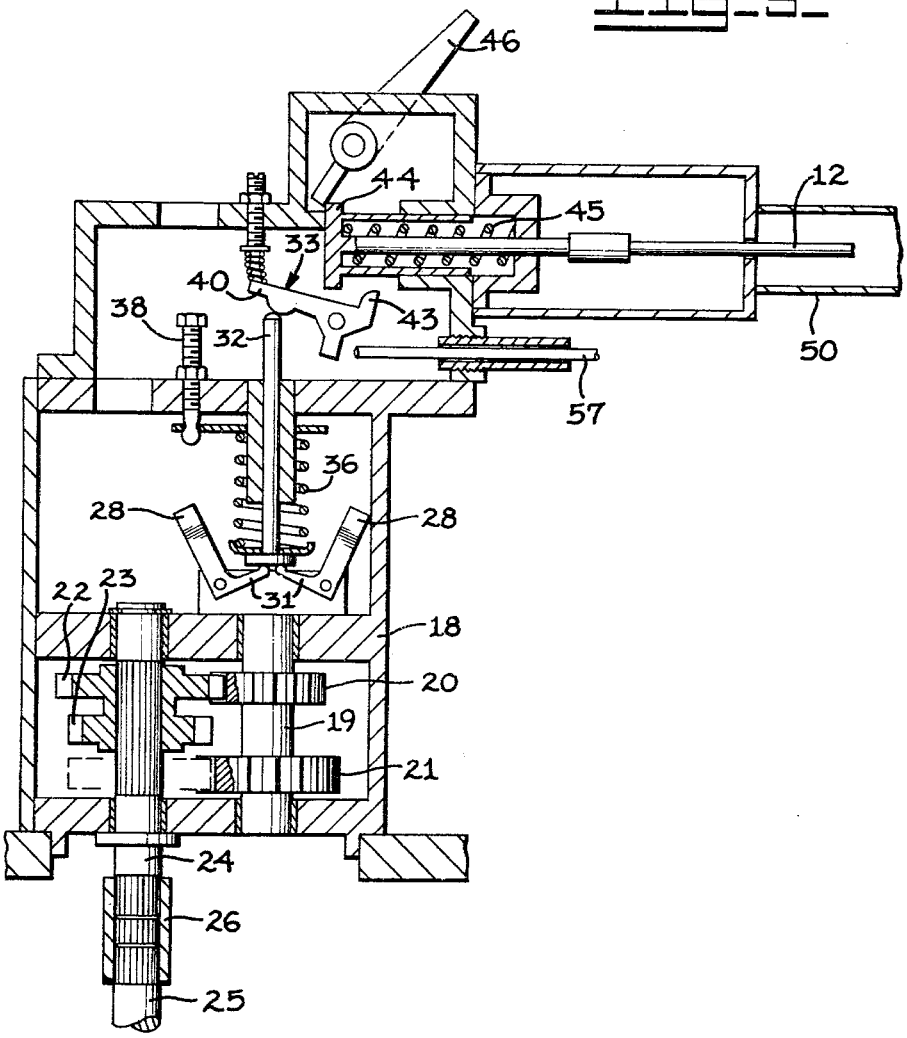
FIG. 3 is a view similar to FIG. 2, but illustrating the control means in its activated condition of operation whereby communication of ambient air and fuel to the engine is cut off.

Referring to FIG. 3, upon upward movement of trip pin 32 to pivot latch means 33 clockwise to release piston 44, spring 45 will move the piston leftwardly. As shown in FIG. 1, such movement of the piston will, in turn, pull on cable 12 to release trip pin 49 from beneath plate 60 of flapper valve 11. The plate will thus move to its 60' shut-off position against stop 62 in the intake manifold whereby communication of air from a compressor stage 83 of a turbocharger 84 to the engine is prevented. The closing of the flapper valve, which is suitably constructed to form a substantial seal within the intake manifold, will function to induce a vacuum within the downstream side of the intake manifold upon continued engine operation.

Such vacuum will function to create a relatively low pressure on the manifold side of plate 69 of vacuum valve 14 to permit the valve to open against the opposing force of relatively light spring 74. The vacuum will thus communicate to chamber 76 of vacuum actuating means 15 via conduit 75. The vacuum thus created in chamber 76 will function to draw plate or diaphragm 78 rightwardly to, in turn, move rack 16 rightwardly to shut-off communication of fuel to the engine. The engine will thus stop since the communication of ambient air and fuel thereto has been terminated.

Upon restarting of the engine, the operator will first pivot lever 67 clockwise from its phantom line position 67' in FIG. 1 to move flapper valve plate 60 to its illustrated raised and open position. While holding lever 67 in such position, lever 46 is then pivoted counterclockwise in FIG. 3 to retract piston 44 to its FIG. 2 recocked position and into engagement with latch means 33. It should be noted that one side of arm 43 of the latch means is rounded to facilitate resetting of the piston to its recocked position.

As described above, the operator has the alternative to shut-off the engine manually. In particular, a pushing-in of knob 53 in FIG. 2 will function to engage rod 57 with arm 59 of latch means 33. The latch means will thus pivot clockwise to release piston 44 whereby the above-described shut-off operation is achieved.

MODIFICATION OF THE OVERSPEED CONTROL MEANS (FIG. 5)

Figure 5:
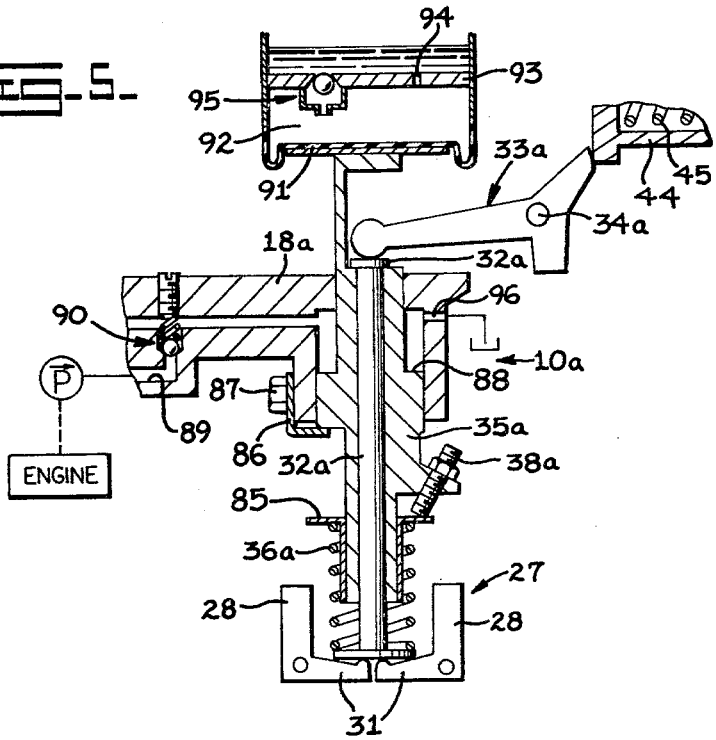
FIG. 5 is a view similar to FIG. 2, but illustrating a modification of the control means.

FIG. 5 illustrates a modification **10*a* of the overspeed control means wherein identical numerals are used to depict corresponding constructions, but with modified constructions in FIG. 5 being accompanied by an "a". The modified control means comprises a trip shaft 32*a* having its lower end engaged with arms 31 of flyweights 28. The trip shaft is slidably mounted in a piston 35*a*, reciprocally mounted in a housing 18*a*, and has a head 32*a'* formed on an upper end thereof and normally engaged on an upper end of the piston. A compression coil spring or biasing means 36*a* is disposed between a lower end of the trip shaft and an annular retainer 85, secured to a lower end of the piston, for biasing the trip shaft into engagement with arms 31**.

The compressive force applied to spring **36*a* may be selectively adjusted by adjusting means comprising a set screw 38*a* threadably mounted on piston 35*a*. As illustrated, an end of the set screw engages retainer 85 to effect this adjusting function. The piston is limited in its downward travel towards flyweight means 27 by means of a bracket or stop means 86 which is secured to housing 18*a* by a cap screw 87**.

The upper end of trip shaft **32*a* engages a latch means 33*a* which is pivotally mounted on housing 18*a* by a pivot pin 34*a*. The latch means is operatively associated with piston 44 to function in the same manner as latch means 33, described above. In contrast to the above-described embodiment, the loading of spring 36*a* against flyweight means 27 is maintained by engine oil pressure acting against an annular face 88 which functions to hold piston 35*a* against stop means 86** during normal engine operation.

An engine oil inlet passage 89 is defined in housing **18*a* to communicate engine oil pressure to annular face 88 of piston 35*a*, via an oil pressure check or drop valve 90. A damping force may be applied to piston 35*a* by means of a flexible diaphragm 91 and reservoir oil contained in a damping chamber 92 for purposes described hereinafter. A baffle plate 93 is mounted in chamber 92 and has an orifice 94 formed therethrough and a fast refill float valve 95 mounted thereon. An orifice 96 communicates the chamber above face 88 of piston 35*a*** with the oil reservoir to maintain the oil pressure in the chamber below a predetermined maximum level.

In operation, and upon starting-up of the associated engine (FIG. 1), chamber 92 will be filled with reservoir oil, via valve 95, and no appreciable oil pressure will be prevalent in passage 89. Upon continued cranking of the engine, flyweights 28 will pivot radially outwardly to move shaft **32*a* upwardly in FIG. 5 against the force of spring 36*a* and against diaphragm 91 and the damping force of chamber 92. Orifice 94 is suitably sized to permit metered flow of oil therethrough from chamber 92, under the upwardly applied force of flyweights 28, to effect a time lag allowing the engine to run for a short period of time, and until an engine-driven oil pump P has built-up oil pressure to its normal operating level in passage 89. In the event such build-up of the oil pressure does not occur (e.g., a break in an oil line communicating with passage 89) continued emptying of chamber 92 will eventually permit shaft 32*a* to trip latch means 33*a* whereby piston 44** will be released to shut-off the engine in the manner described above.

Assuming build-up of oil pressure in passage 89 to its normal operating level, check valve 90 will open to apply such pressure to face 88 of piston **35*a*. Thus, the force of such oil pressure will be applied in series against spring 36*a* to counteract upward movement of trip shaft 32*a* to normally prevent tripping of latch means 33*a*. However, upon overspeed of the engine whereby flyweights 28 pivot outwardly sufficiently to trip latch means 33*a*, via shaft 32*a*, piston 44** will be released to shut-off the engine, also in the above-described manner.

Other aspects, objects and advantages of this invention can be obtained from a study of the drawings, the disclosure and the appended claims.

We claim:

1. An overspeed shut-off system in combination with an internal combustion engine having an intake manifold (13) connected thereto for communicating ambient air to said engine and fuel control means (17) for supplying combustible fuel to said engine, said shut-off system comprising, first valve means (11) for opening or closing said manifold (13) to selectively communicate ambient air therethrough, second valve means (14) for movement between a closed position and an open position communicating a vacuum from said intake manifold therethrough in response to closing of said first valve means, vacuum actuating means (15) for actuating said fuel control means (17) to shut-off the supply of fuel from said fuel control means (17) to said engine in response to opening of said second valve means (14), and communication of a vacuum from said intake manifold (13) to said vacuum actuating means (15), and overspeed control means (10) responsive to the speed of said engine for automatically closing said first valve means (11) when such speed exceeds a predetermined maximum.

2. The combination of claim 1 wherein said first valve means (11) comprises a flapper valve including a plate (60) movably mounted on said manifold (13) for movement between open and closed positions thereon.

3. The combination of claim 2 further including stop means (62) for engaging and holding said plate in its closed position.

4. The combination of claim 2 further including a lever means (67) for selectively moving said plate (60) between its open and closed positions.

5. The combination of claim 2 further including assist means (63,64) for biasing said plate (60) towards its closed position upon release of said plate (60) by said overspeed control means (10).

6. The combination of claim 1 wherein said second valve means (14) includes a plate (69) normally disposed in a closed position on an opening (70) formed through a wall of said manifold (13) and spring means (74) for normally biasing said plate (69) to its closed position on said opening (70).

7. The combination of claim 1 wherein said vacuum actuating means (15) includes a piston (78), and spring means (80) for normally biasing said piston (78) to an inactive position for permitting said fuel control means (17) to supply fuel to said engine.

8. The combination of claim 1 wherein said overspeed control means (10) includes a push-pull cable (12) having a trip pin (49) secured on an end thereof to extend within said intake manifold (13), said trip pin (49) normally engaged with said first valve means (11) for normally holding said first valve means (11) in an open position for permitting communication of ambient air through said intake manifold (13).

9. The combination of claim 8 wherein said overspeed control means (10) further includes a housing (18) and further including a tubular conduit (50) secured between said housing (18) and said intake manifold (13) to fully cover and protect said push-pull cable (58).

10. The combination of claim 1 wherein said overspeed control means (10) includes a rotary shaft (19), flyweight means (27) for centrifugal movement between minimum and maximum speed positions in response to rotation of said shaft (19), trip means (32) engageable with said flyweight means (27) for movement thereby in response to movement thereof, engine control means (44) for movement between an inactive first position and an active second position for actuating said first valve means (11) for shutting-down said engine, and latch means (33) for normally holding said engine control means (10) in its first position and for permitting said engine control means (10) to move to its second position in response to movement of said flyweight means (27) to its maximum speed position.

11. The combination of claim 10 wherein said flyweight means (27) includes at least one pair of flyweights (28) pivotally connected (at 30) to a bracket (29) secured to said shaft (19).

12. The combination of claim 11 further including an arm (31) secured to each of said flyweights (28), each said arm (31) disposed adjacent to an end of said trip means (32) for engaging and moving said trip means (32) upon radial outward movement of a respective one of said flyweights (28).

13. The combination of claim 10 wherein said trip means (32) includes a shaft (32) reciprocally mounted in a housing (35) and biasing means (36) for biasing said shaft (32) towards engagement with said flyweight means (27).

14. The combination of claim 13 further including adjustment means (38) for selectively adjusting the biasing force on said spring means (36).

15. The combination of claim 10 wherein said engine control means (44) includes a reciprocal piston (44) normally engaging said latch means (33).

16. The combination of claim 15 further including biasing means (45) for normally urging said piston (44) into engagement with said latch means (33).

17. The combination of claim 15 further including push-pull cable means (12) for connecting said piston (44) to said first valve means (11) whereby releasing said latch means (33) will pull said cable (12) to shut-down said engine.

18. The combination of claim 15 wherein said latch means (33) includes a first arm (40) normally engaged with said trip means (32) and a second arm (43) normally engaged with said piston (44).

19. The combination of claim 18 further including adjustment means (41) for selectively biasing said first arm (40) into contact with said trip means (32) under a predetermined, adjusted force.

20. The combination of claim 10 further including reset means (46) for resetting said engine control means (44) from its second position to its first position for normal holding by said latch means (33).

21. The combination of claim 10 further including manual control means (52) for selectively releasing said latch means (33) to move said engine control means (44) to its second position for shutting-down said engine.

22. The combination of claim 21 wherein said manual control means (52) includes a reciprocal trip pin (57) having an end thereof disposed adjacent to said latch means (33), a reciprocal control member (54), and a cable (58) connected between said trip pin (57) and said control member (54) for reciprocating said trip pin (57) in response to reciprocation of said control member (54).

23. The combination of claim 1 wherein said overspeed control means (10*a*) includes flyweight means (27) for movement between minimum and maximum speed positions, a housing (18*a*), a piston (35*a*) reciprocally mounted in said housing (18*a*), and a trip shaft (32*a*) reciprocally mounted in said piston (35*a*), and engageable with said flyweight means (27).

24. The combination of claim 23 further including biasing means (36*a*) for biasing said trip shaft (32*a*) towards engagement with said flyweight means (27).

25. The combination of claim 24 further including means (89,90) for communicating fluid pressure at a predetermined level to said piston (35*a*) for aiding said biasing means (36*a*) in biasing said trip shaft (32*a*) towards said flyweight means (27).

26. The combination of claim 25 further including means (91–95) for applying a fluid damping force to said piston (35*a*) and said flyweight means (27) to permit build-up of said fluid pressure to its predetermined level upon start-up of said engine.

27. The combination of claim 23 further including stop means (86) for limiting travel of said piston (35*a*) towards said flyweight means (27).

28. The combination of claim 1 wherein said overspeed control means (10) includes a rotary shaft (24) and further includes change speed gear means (20–23) for selectively changing the speed of said rotary shaft (24) for pre-testing said overspeed shut-off system.

* * * * *